US010835792B1

(12) United States Patent
Ludwick

(10) Patent No.: US 10,835,792 B1
(45) Date of Patent: Nov. 17, 2020

(54) PUTTING TRAINING DEVICE

(71) Applicant: Timothy K. Ludwick, Evans, GA (US)

(72) Inventor: Timothy K. Ludwick, Evans, GA (US)

( * ) Notice: Subject to any disclaimer, the term of this patent is extended or adjusted under 35 U.S.C. 154(b) by 0 days.

(21) Appl. No.: 16/594,053

(22) Filed: Oct. 6, 2019

(51) Int. Cl.
*A63B 69/36* (2006.01)
*A63B 57/40* (2015.01)
*E01C 13/08* (2006.01)

(52) U.S. Cl.
CPC ..... *A63B 57/40* (2015.10); *A63B 69/3676* (2013.01); *E01C 13/08* (2013.01)

(58) Field of Classification Search
CPC ..... A63B 57/40; A63B 69/3676; E01C 13/08
USPC ..... 473/174, 179–189
See application file for complete search history.

(56) References Cited

U.S. PATENT DOCUMENTS 4,275,886 A * 6/1981 Bannon ..... A63B 57/40 473/180
4,280,698 A * 7/1981 Troiano ..... A63B 57/357 473/179
4,906,006 A * 3/1990 Sigunick ..... A63B 57/357 473/185
4,928,417 A * 5/1990 Boudreau ..... G09F 23/00 40/660
5,029,856 A * 7/1991 Bookspan ..... A63B 57/357 473/175
5,078,394 A * 1/1992 Kretz ..... A63B 69/3676 473/179
5,390,917 A * 2/1995 Mendoza ..... A63B 69/3676 473/179
6,110,053 A * 8/2000 Sjoblom ..... A63B 57/40 473/179
9,415,292 B2 * 8/2016 Reino ..... A63B 69/3676
2004/0235580 A1 * 11/2004 Barlow ..... A63B 57/357 473/175
2010/0331094 A1 * 12/2010 Graves ..... A63B 57/357 473/179
2018/0171565 A1 * 6/2018 Kruger ..... E01C 13/08

OTHER PUBLICATIONS

Players 3-Ring Putt Trainer (Attachment 1).
77tech Golf Putting Green System (Attachment 2).

* cited by examiner

*Primary Examiner* — Nini F Legesse
(74) *Attorney, Agent, or Firm* — Cortney S. Alexander; Kent & Risley LLC

(57) ABSTRACT

A putting training device adapted for insertion into a golf hole. The putting target may include a base comprising a circular lip comprising (i) an outer edge and an inner edge, wherein the inner edge defines a circular aperture, and (ii) a sidewall extending downward from the inner edge. The training device may also comprise a synthetic-turf component fixed to a top surface of the circular lip. The outer edge of the circular lip may be approximately 4.25 inches in diameter such that it may fit securely inside a standard golf hole. The inner edge of the circular lip is smaller in diameter than the diameter of a standard golf hole, thereby presenting a more difficult target for the user for training purposes. In one aspect, the diameter of the inner edge may be approximately one and a half times the diameter of a standard golf ball.

19 Claims, 3 Drawing Sheets

PUTTING TRAINING DEVICE

BACKGROUND

Putting is difficult. Even professional golfers often find it to be the weak spot in their game. The present disclosure relates to putting training devices for assisting golfers in improving their putting performance.

When golfers are putting from a distance, the conventional technique is to putt toward the hole, or to a point to the right or left of the hole (allowing for slope effect), with the hole itself remaining the target. However, when putting from within five feet of the hole, golfers frequently change their technique. Instead of putting toward a target, golfers often try to hit the ball along an imaginary line running between their ball and the hole. Sometimes, golfers use balls with a line on the ball itself, which they align with the imaginary line they are trying to putt along. In focusing on the imaginary line, they are no longer focusing on the target they are trying to hit. And, consciously or unconsciously, they are thinking that executing a putting stroke that attains that abstract, perfect line now makes the target (i.e., the hole) feel (or seem) too small to hit.

When the hole seems like an impossible target, pressure increases. Increased pressure leads to increased muscle tension, including in the forearm muscles. When the forearm muscles "lock up," the golfer loses his or her natural motion. This often results in pushing or oversteering the ball, resulting in poor-quality putting. This phenomenon can particularly impact the best golfers because they have the best musculature. While that musculature helps them in driving the ball off the tee and in other scenarios, it can enhance the lock-up effect created by the tension of putting.

Various putting training devices have been offered in an effort to help golfers improve their putting. Many of these training devices rely on guides, lines, mirrors, or other visual aids intended to help show the golfer where to hit the ball. However, these visual aids can actually increase tension in real-life situations because they are not used on the course. The conventional putting trainers take the golfer's focus off the target and place it onto artificial visual aids. However, those visual aids that may have been helpful in practice are nowhere to be found on the golf course. Having lost his crutch, the golfer is left alone with an intimidating putt.

As a result, a need exists for a putting training device that does not rely on artificial visual aids that take the golfer's focus off the target. A need exists for a putting training device that places the golfer's focus on the target. Moreover, a need exists for a putting training device that makes the real-life situation easier than the practice situation. This will help reduce stress in putting situations during play. A need also exists for a training device that more closely resembles the appearance of a putting green so that, during play, the absence of the training device does not create a wholly different visual scenario from the practice environment.

SUMMARY

Examples described herein include putting training devices for assisting golfers in improving their putting, including by keeping the golfer's focus on the target, resembling the environment of course play, avoiding visual aids that will not be present during course play, and providing a practice target that is more difficult than a real-life target, thereby making putting during course play easier than putting in a practice environment.

In one aspect, a putting training device is adapted for insertion into a golf hole. The putting target may include a base comprising a circular lip comprising an outer edge and an inner edge, wherein the inner edge defines a circular aperture, and a sidewall extending downward from the inner edge. The putting training device may also comprise a synthetic-turf component fixed to a top surface of the circular lip, wherein the synthetic-turf component comprises synthetic turf. In one aspect, the outer edge of the circular lip may be approximately 4.25 inches in diameter. In another aspect, the circular lip may have a pressure seal fixed to an underside thereof.

The diameter of the inner edge of the circular lip may be between approximately 2.4 inches and approximately 2.8 inches. In another aspect, the inner edge of the circular lip may be approximately 2.57 inches in diameter (or approximately one and a half times the diameter of a standard golf ball). In yet another aspect, the inner edge of the circular lip may be approximately 2.95 inches in diameter.

The sidewall may extend between approximately 0.75 inches and approximately 1.0 inches downward from the inner edge of the circular lip. In one aspect, the base may include a closed bottom surface at an end of the sidewall opposite the circular lip. In another aspect, the sidewall may be open at the bottom. The sidewall may be white (the color of a standard golf hole).

The synthetic-turf component may be fixed to a top surface of the circular lip by hook-and-loop fasteners 212. In another aspect, the synthetic-turf component may be fixed to the circular lip's top surface by an adhesive. In one aspect, the synthetic turf may extend approximately 0.625 inches upward from the circular lip.

In another aspect, the putting training device may comprise an insert that removably fits inside the inner edge of the circular lip. The insert may comprise a second circular lip comprising a second outer edge and a second inner edge, wherein the second inner edge defines a second circular aperture. The insert may also comprise a second sidewall extending downward from the second inner edge. The insert may further comprise a second synthetic-turf component fixed to a top surface of the second circular lip.

In another aspect, a putting training device may comprise a ring of synthetic turf comprising an inner edge defining a circular aperture. The putting training device according to this aspect may include a sidewall extending downward from the inner edge.

Both the foregoing general description and the following detailed description are exemplary and explanatory only and are not restrictive of the claims. The foregoing has outlined preferred and alternative features of various aspects so that those skilled in the art may better understand the detailed description that follows. Those skilled in the art will appreciate that they can readily use the disclosed examples as a basis for designing or modifying additional examples for achieving the same purposes as the examples described herein. Such additional constructions do not depart from the spirit and scope of the disclosure in its broadest form.

DESCRIPTION OF THE EXAMPLES

The following Description of the Examples is directed to very specific embodiments, including examples illustrated in the accompanying drawings. The following structures and other details are provided solely as examples and in no way limit the scope of the present disclosure. Wherever possible, the same reference numbers will be used throughout the drawings to refer to the same or like parts. Directional terms are used in the following description for purposes of providing relative reference only and are not intended to suggest any limitations on how any article is to be positioned during use or relative to an environment except where expressly indicated.

A putting training device is provided that is adapted for insertion into a golf hole. The putting training device may include a base comprising a circular lip comprising (i) an outer edge and an inner edge, wherein the inner edge defines a circular aperture, and (ii) a sidewall extending downward from the inner edge. The training device may also comprise a synthetic-turf component fixed to a top surface of the circular lip. The outer edge of the circular lip may be approximately 4.25 inches in diameter such that it may fit securely inside a standard golf hole. The inner edge of the circular lip is smaller in diameter than the diameter of a standard golf hole, thereby presenting a more difficult target for the user for training purposes. In one aspect, the diameter of the inner edge may be approximately one and a half times the diameter of a standard golf ball.

Figure 1:
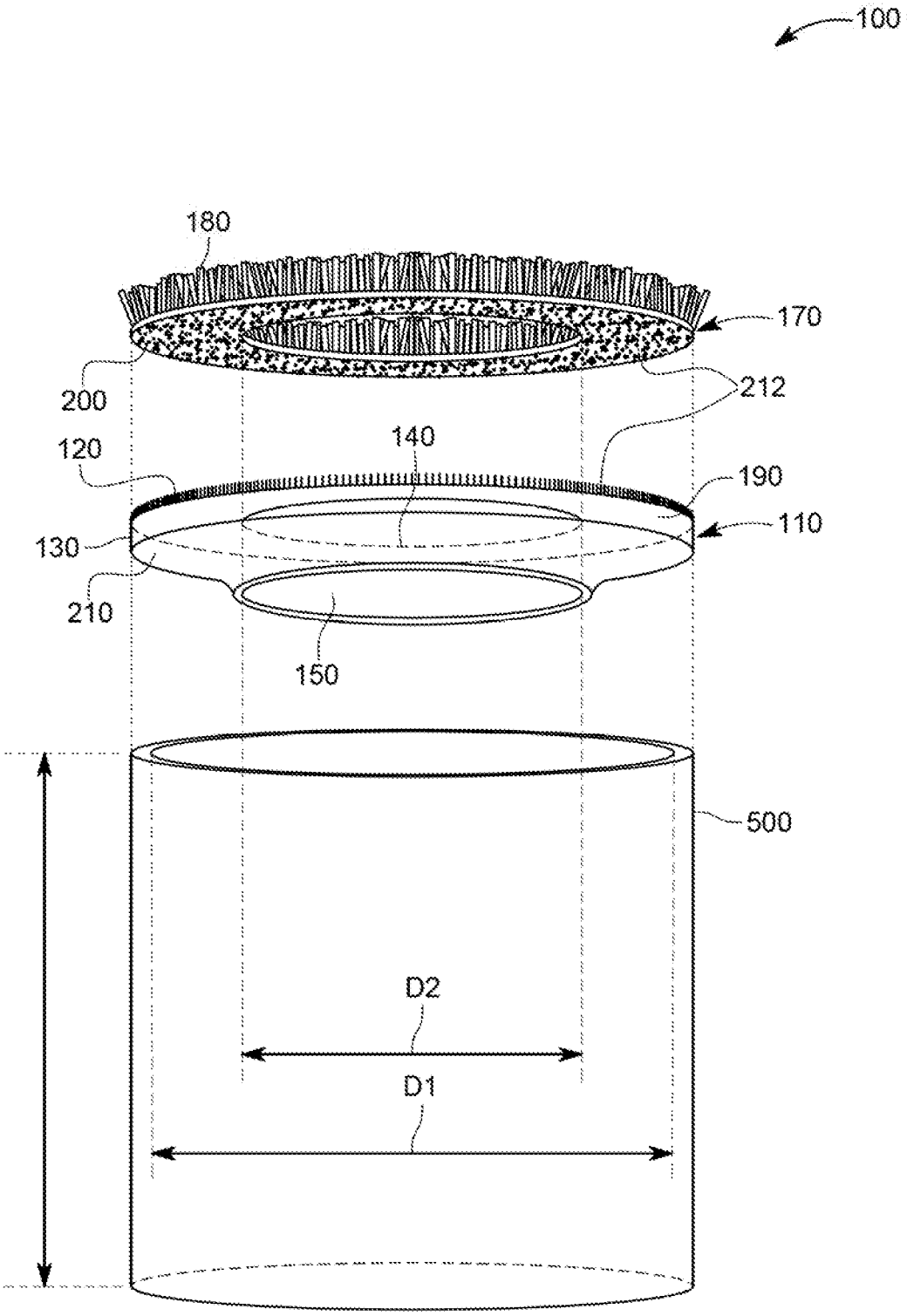
FIG. 1 is an exploded view of an example putting training device adapted for insertion into a golf hole.

FIG. 1 is an exploded view of an example putting training device 100 adapted for insertion into a golf hole comprising cup 500 having a diameter D1. The putting training device 100 may comprise a base 110. Base 110 may be formed from a rigid material, including, for example, injection-molded plastic. Alternatively, base 110 may be formed in other ways known in the art.

The base 110 may comprise a circular lip 120 that comprises an outer edge 130 and an inner edge 140. The inner edge 140 may define a circular aperture at its center having a diameter D2. The base 110 may also include a sidewall 150 extending downward from the circular aperture. For example, sidewall 150 may extend between approximately 0.75 inches and 1.0 inches downward from the circular lip 120. In one embodiment, the base 110 may include a closed bottom surface 160 at an end of the sidewall 150 opposite the circular lip 120. In another aspect, sidewall 150 may extend downward approximately four inches from the circular lip 120. Since a regulation golf hole is a minimum of four inches deep, a four-inch sidewall would often reach to the bottom of the hole. In one aspect, sidewall 150 may be white so that it has generally the same appearance as a typical golf hole. This helps putting training device 100 resemble a standard putting situation. While FIG. 1 illustrates the base 110 as one piece, it may also comprise two or more pieces. For example, circular lip 120 might be formed from a different piece than sidewall 150.

Putting training device 100 may also comprise a synthetic-turf component 170, comprising synthetic turf 180, fixed to a top surface 190 of the circular lip 120. The synthetic turf 180 may extend approximately 0.625 inches upward from the circular lip 120. Alternatively, the synthetic turf 180 may extend upward to a different height selected to match other heights at which putting greens may be maintained. In one aspect, synthetic-turf component 170 may include a rubber base 200. Synthetic-turf component 170 may be fixed to the circular lip 120 by an adhesive. In another aspect, synthetic-turf component 170 may be removably fixed to the circular lip 120, such as by hook-and-loop fasteners. In aspects in which synthetic-turf component 170 is removably fixed to the circular lip 120, a user may select among synthetic-turf components having synthetic turf 180 of differing heights in order to match the turf of a particular putting green or other environment in which putting training device 100 may be used.

The diameter of a regulation United States Golf Association golf hole is 4.25 inches (which is the same standard used by the Royal and Ancient Golf Club, throughout Europe and the rest of the world). Golf RSA (the unified body of the South African Golf Association & Womens Golf South Africa) also sets 4.25 inches as the regulation diameter of a golf hole. Thus, in one aspect, the outer edge 130 of the circular lip 120 may be approximately 4.25 inches in diameter to facilitate insertion into a standard golf hole. While the diameter of outer edge 130 need not be exactly 4.25 inches, it may be sufficiently close to that diameter to allow the base 110 to fit securely within a regulation golf hole. In one aspect, a pressure seal 210 may be fixed to an underside of base 110 to facilitate a secure fit, as well as quick placement and removal, within a golf hole.

Figure 2:
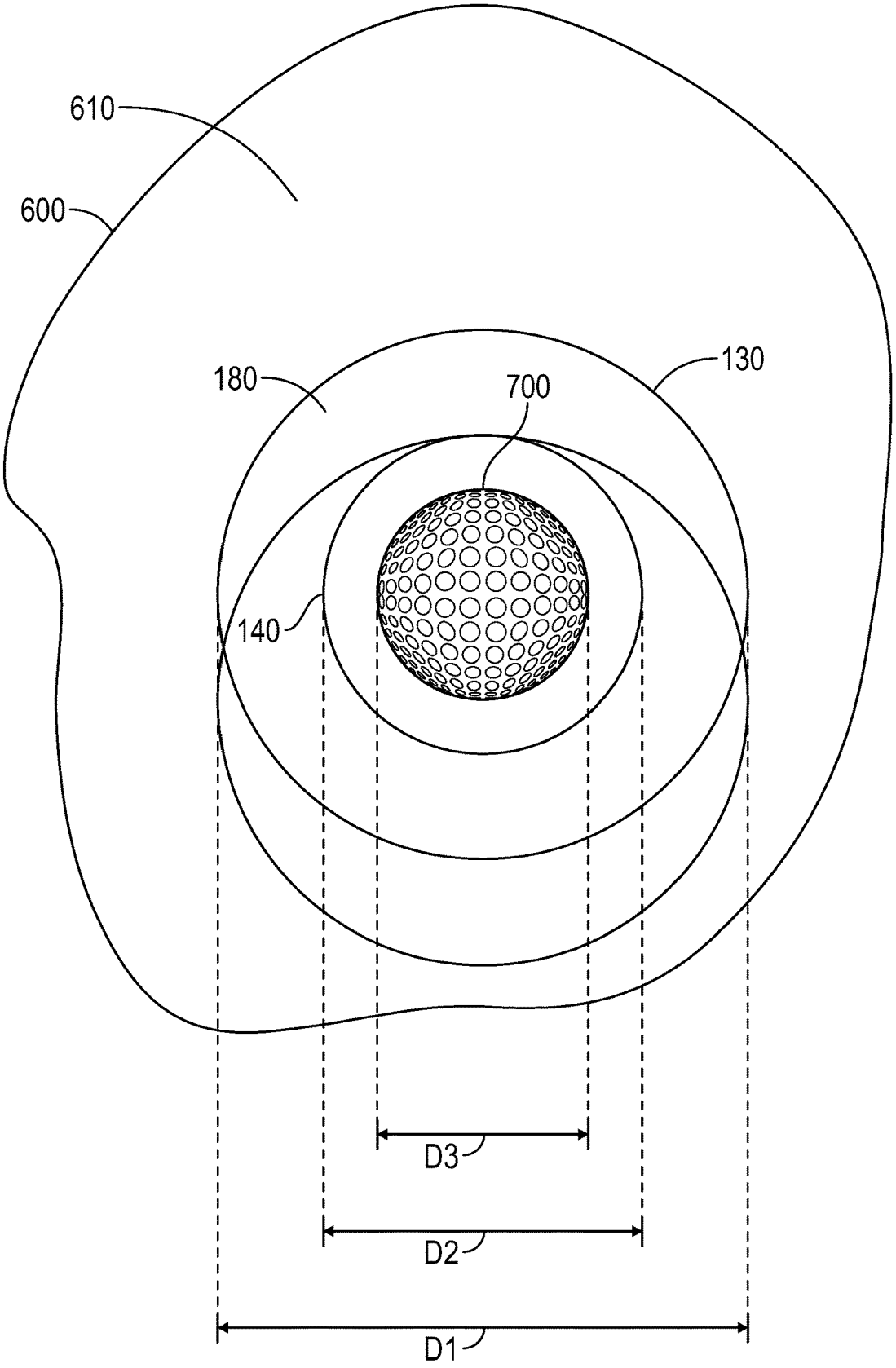
FIG. 2 is a top view of the example putting training device of FIG. 1.

In one aspect, the inner edge 140 of the circular lip 120 may be between approximately 2.4 inches and approximately 2.8 inches in diameter. In one aspect, the inner edge 140 may be approximately 2.57 inches in diameter. Since a standard golf ball is 1.68 inches in diameter, 2.57 inches represents approximately 1.5 ball widths (e.g., the ratio of the diameter D2 of inner edge 140 and the diameter D3 of golf ball 700 as illustrated in FIG. 2). In another aspect, the inner edge 140 may be approximately 2.95 inches in diameter, which is approximately 70% of the diameter of a regulation golf hole.

In another aspect of the putting training device shown in FIG. 1, putting training device 100 may comprise an insert that removably fits inside the circular lip 120. The insert may comprise a second circular lip comprising a second outer edge and a second inner edge. The insert may also comprise a second sidewall extending downward from the second circular lip. The insert may further comprise a second synthetic-turf component with synthetic turf extending upwardly therefrom. The second synthetic-turf component may be fixed to a second top surface of the second circular lip. In one aspect, the second inner edge may be approximately 2.57 inches in diameter and (in this aspect) the inner edge 140 of the base 110 may be approximately 2.95 inches in diameter. In this aspect, the putting training device 100 may offer more than one level of difficulty. A user desiring a more difficult target may use putting training device 100 with the insert in place, resulting in a target of smaller diameter (i.e., the diameter of the second inner edge). A user desiring a less difficult target may remove the insert, resulting in a target of larger diameter (i.e., the diameter of inner edge 140 of circular lip 120).

FIG. 2 is a top view of the example putting training device of FIG. 1 inserted into a golf hole. As illustrated in FIG. 2, the putting training device 100 may be substantially the same diameter of the golf hole to facilitate continuity between a putting green 600 and the synthetic turf 180. In one aspect, a diameter of inner edge 140 constitutes about 1.5 ball widths, which translates to a diameter of approximately 2.57 inches for a standard 1.68-inch golf ball.

Figure 3:
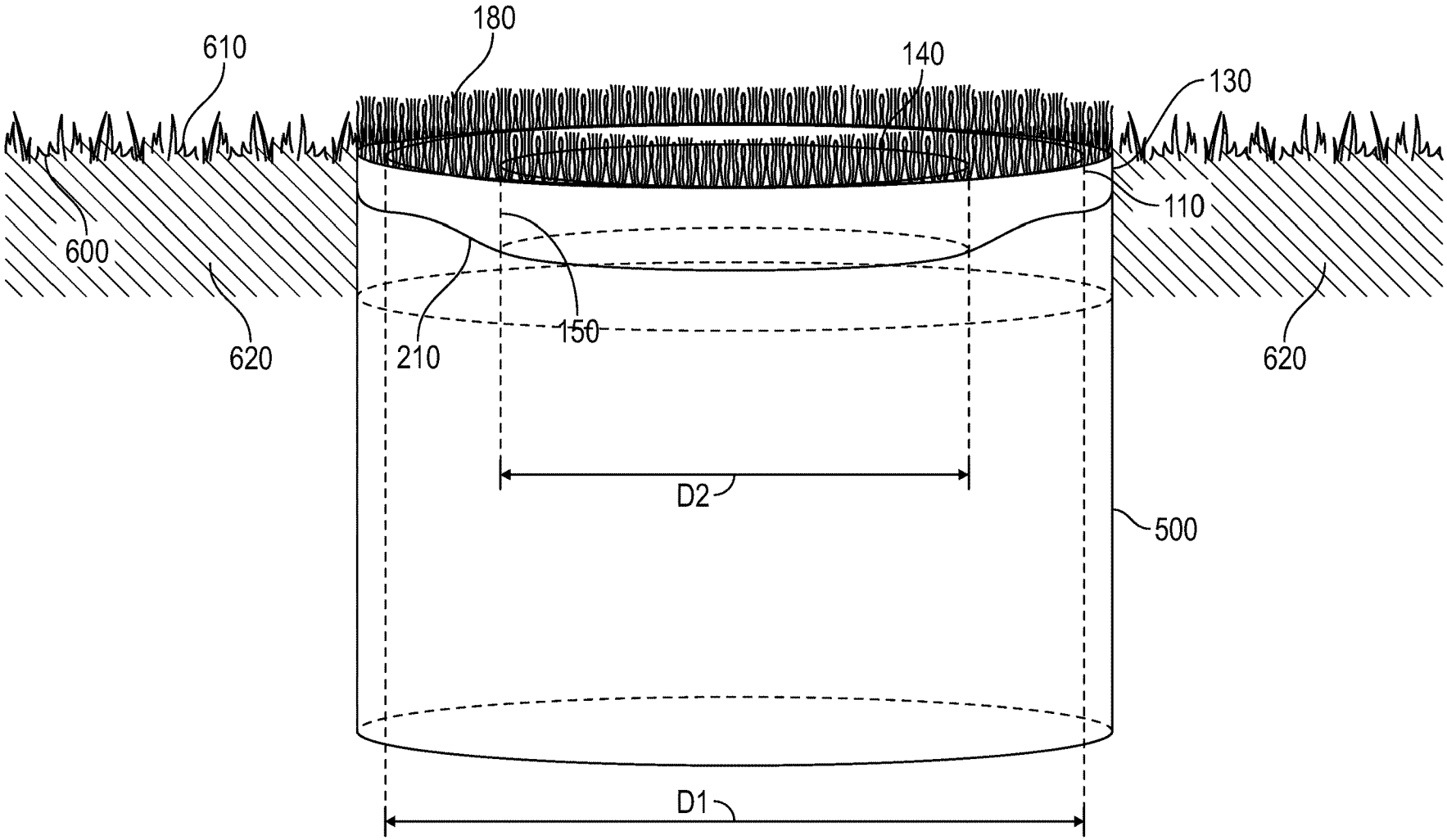
FIG. 3 is a cross-section view of the example putting training device of FIG. 1 inserted into a golf hole.

FIG. 3 is a cross-section view of the example putting training device of FIG. 1 inserted into a golf hole in putting green 600. As illustrated in FIG. 3, putting green 600 includes turf 610, which may be natural or synthetic. The height of synthetic turf 180 may be sized to generally align with the height of putting-green turf 610.

As discussed above, a regulation golf hole is at least four inches deep, including at least one inch of soil extending downward from the surface of the putting green. Below the soil is cup 500, which is typically at least three inches deep such that the total depth of the hole (soil and cup) is at least four inches. When the user inserts the putting training device 100 into a golf hole, he or she can match the height of synthetic turf 180 to the surrounding putting-green turf 610. In other words, the shorter the putting-green turf 610, the deeper the user will insert the putting training device 100 into a golf hole. In this manner, putting training device 100 provides a substantially seamless transition between putting-green turf 610 and synthetic turf 180, thereby eliminating or at least minimizing any disruption to the path of a golf ball as it rolls onto synthetic turf 180 from putting-green turf 610. As shown in FIG. 3, in one aspect, putting training device 100 fits within a hole defined by soil 620 above cup 500.

The putting training device 100 does not rely on artificial visual aids that take the golfer's focus off the target. This facilitates improved putting during course play because the golfer has not grown accustomed to an aid (such as a guide line) that is absent during play, when the golfer needs it most. The putting training device 100 also focuses the golfer's attention on the target (i.e., the hole). This improves performance and follows the standard technique in other types of golf shots (in which the golfer looks toward the hole as he hits instead of the course in front of the target). Moreover, the putting training device 100 makes putting during course play easier than the practice scenario. That is, the golfer has practiced with putting training device 100, which presents a smaller target than a regulation golf hole. When the golfer putts toward the actual golf hole during course play, he is putting toward a target that is larger than the practice target used in practice. This helps reduce stress in putting situations during play, helping to avoid or at least reduce the forearm tightening that accompanies stress (which tends to negatively impact putting). The putting training device 100 also closely resembles the appearance of a putting green so that, during play, the absence of the training device does not create a wholly different visual scenario from the practice environment. Furthermore, since synthetic turf 180 closely matches putting-green turf 610, putting training device 100 has little or no impact on the ball's course of travel during putting.

Other examples of the disclosure will be apparent to those skilled in the art from consideration of the specification and practice of the examples disclosed herein. Moreover, the various features of the examples described here are not mutually exclusive. Rather, any feature of any example described herein can be incorporated into any other suitable example. It is intended that the specification and examples be considered as exemplary only, with a true scope and spirit of the disclosure being indicated by the following claims.

What is claimed is:

1. A putting training device adapted for insertion into a golf hole, comprising:

a base adapted for secure placement in a golf hole by push fit comprising a circular lip comprising an outer edge and an inner edge, wherein the inner edge defines a circular aperture and has a diameter between 2.4 inches and 2.8 inches, wherein the circular lip is generally flat; and a sidewall extending downward from the inner edge; and a synthetic-turf component fixed to a top surface of the circular lip, the synthetic-turf component comprising synthetic turf.

2. The putting training device of claim 1, wherein a diameter of the outer edge of the circular lip is approximately 4.25 inches.

3. The putting training device of claim 1, wherein a diameter of the inner edge of the circular lip is approximately 2.57 inches.

4. The putting training device of claim 1, wherein a diameter of the inner edge of the circular lip is approximately 2.95 inches.

5. The putting training device of claim 1, wherein the base includes a closed bottom surface at an end of the sidewall opposite the circular lip.

6. The putting training device of claim 1, wherein the sidewall extends between approximately 0.75 inches and approximately 1.0 inches downward from the inner edge.

7. The putting training device of claim 1, wherein the synthetic-turf component is fixed to the base by hook-and-loop fasteners.

8. The putting training device of claim 1, wherein the synthetic turf extends approximately 0.625 inches upward from the circular lip.

9. The putting training device of claim 1, wherein the sidewall is white.

10. The putting training device of claim 1, wherein a pressure seal is fixed to an underside of the circular lip to facilitate a secure fit in the golf hole.

11. A putting training device adapted for insertion into a golf hole, comprising:

a base adapted for secure placement in a golf hole by push fit;

a ring of synthetic turf on a generally flat top surface of a circular lip comprising an inner edge defining a circular aperture having a diameter between 2.4 inches and 2.8 inches; and a sidewall extending downward from the inner edge.

12. The putting training device of claim 11, wherein an outer diameter of the ring is approximately 4.25 inches.

13. The putting training device of claim 11, wherein a diameter of the inner edge is approximately one and a half times the diameter of a standard golf ball.

14. The putting training device of claim 11, wherein the sidewall is white.

15. The putting training device of claim 11, further comprising a base to which the ring of synthetic turf is attached by hook-and-loop fasteners.

16. A putting training device adapted for insertion into a golf hole, comprising:

A base adapted for secure placement in a golf hole by push fit comprising a circular lip having an outer edge having an outer diameter of approximately 4.25 inches, and an inner edge defining a circular aperture, wherein a diameter of the inner edge is between one and a quarter times and two times the diameter of a standard golf ball, and wherein the circular lip is generally flat; and a sidewall extending downward from the inner edge; and a synthetic-turf component fixed to a top surface of the circular lip.

17. The putting training device of claim 16, wherein the diameter of the inner edge is one and a half times the diameter of a standard golf ball.

18. The putting training device of claim 16, wherein the synthetic-turf component is fixed to the top surface of the circular lip by hook-and-loop fasteners.

19. The putting training device of claim 16, wherein the synthetic-turf component comprises synthetic turf extending upward approximately 0.625 inches from the circular lip.

* * * * *